US008631880B2

(12) United States Patent
Murthy et al.

(10) Patent No.: US 8,631,880 B2
(45) Date of Patent: Jan. 21, 2014

(54) POWER TOOL WITH IMPACT MECHANISM

(75) Inventors: Sankarshan Murthy, Towson, MD (US); Qiang Zhang, Lutherville, MD (US); Daniel Puzio, Baltimore, MD (US); James T. Rill, Hampstead, MD (US)

(73) Assignee: Black & Decker Inc., Newark, DE (US)

( * ) Notice: Subject to any disclaimer, the term of this patent is extended or adjusted under 35 U.S.C. 154(b) by 430 days.

(21) Appl. No.: 12/764,714

(22) Filed: Apr. 21, 2010

(65) Prior Publication Data

US 2010/0276168 A1 Nov. 4, 2010

Related U.S. Application Data

(60) Provisional application No. 61/174,143, filed on Apr. 30, 2009.

(51) Int. Cl.
*B25D 15/02* (2006.01)

(52) U.S. Cl.
USPC ..... 173/109; 173/93.5; 173/216

(58) Field of Classification Search
USPC ..... 173/93.5, 48, 109, 122, 216; 457/271, 457/331
See application file for complete search history.

(56) References Cited

U.S. PATENT DOCUMENTS 3,195,702 A 7/1965 Alexander
3,207,237 A 9/1965 Wanner
3,584,695 A 6/1971 Turnbull
3,648,784 A 3/1972 Schoeps
3,710,873 A 1/1973 Allen
3,741,313 A 6/1973 States
4,428,438 A 1/1984 Holzer
4,986,369 A 1/1991 Fushiya et al.
5,025,903 A 6/1991 Elligson
5,080,180 A 1/1992 Hansson
5,269,733 A * 12/1993 Anthony, III ..... 475/331
5,447,205 A 9/1995 Thurler
5,457,860 A 10/1995 Miranda
5,458,206 A 10/1995 Bourner et al.
5,474,139 A 12/1995 Odendahl et al.

(Continued)

FOREIGN PATENT DOCUMENTS

DE 1949415 A1 10/1970
DE 1652685 A1 12/1970

(Continued)

*Primary Examiner* — Alexandra Elve
*Assistant Examiner* — Nathaniel Chukwurah
(74) *Attorney, Agent, or Firm* — Harness, Dickey & Pierce, P.L.C.

(57) ABSTRACT

A power tool with a housing, a motor, a transmission, a spindle and an impact mechanism. The motor has an output shaft that drives the transmission. The transmission has a plurality of planet gears, a planet carrier journally supporting the planet gears for rotation about an axis, and a ring gear that is in meshing engagement with the planet gears. The impact mechanism has a plurality of anvil lugs, an impactor and an impactor spring. The anvil lugs are coupled to the ring gear and are not engaged by the planet gears. The impactor is mounted to pivot about the spindle and has a plurality of hammer lugs. The impactor spring biases the impactor toward the ring gear to cause the hammer lugs to engage the anvil lugs. A power tool having an impact mechanism with an external adjusting member that can be moved to vary a trip torque of the impact mechanism is also provided.

30 Claims, 11 Drawing Sheets

(56) References Cited

U.S. PATENT DOCUMENTS

| | | | | |
|---|---|---|---|---|
| 5,673,758 | A | 10/1997 | Sasaki et al. | |
| 5,706,902 | A | 1/1998 | Eisenhardt | |
| 5,711,380 | A | 1/1998 | Chen | |
| 5,836,403 | A | 11/1998 | Putney et al. | |
| 5,842,527 | A | 12/1998 | Arakawa et al. | |
| 5,868,208 | A | 2/1999 | Peisert et al. | |
| 6,135,212 | A | 10/2000 | Georgiou | |
| 6,142,242 | A | 11/2000 | Okumura et al. | |
| 6,176,321 | B1 | 1/2001 | Arakawa et al. | |
| 6,196,330 | B1 | 3/2001 | Matthias et al. | |
| 6,223,833 | B1 | 5/2001 | Thurler et al. | |
| D462,594 | S | 9/2002 | Flickinger | |
| 6,457,535 | B1 | 10/2002 | Tanaka | |
| 6,457,635 | B1 | 10/2002 | Scicluna | |
| 6,535,212 | B1 | 3/2003 | Goto et al. | |
| 6,535,636 | B1 | 3/2003 | Savakis et al. | |
| 6,691,796 | B1 | 2/2004 | Wu | |
| 6,733,414 | B2 * | 5/2004 | Elger | 475/331 |
| 6,805,207 | B2 | 10/2004 | Hagan et al. | |
| 6,834,730 | B2 | 12/2004 | Gass et al. | |
| 6,887,176 | B2 | 5/2005 | Sasaki | |
| 6,892,827 | B2 | 5/2005 | Toyama et al. | |
| 6,938,526 | B2 | 9/2005 | Milbourne et al. | |
| 6,976,545 | B2 | 12/2005 | Greitmann | |
| 7,032,683 | B2 | 4/2006 | Hetcher et al. | |
| 7,036,406 | B2 | 5/2006 | Milbourne et al. | |
| 7,048,075 | B2 | 5/2006 | Saito et al. | |
| 7,073,605 | B2 | 7/2006 | Saito et al. | |
| 7,073,608 | B2 | 7/2006 | Droste | |
| 7,086,483 | B2 | 8/2006 | Arimura et al. | |
| 7,093,668 | B2 | 8/2006 | Gass et al. | |
| 7,101,300 | B2 | 9/2006 | Milbourne et al. | |
| 7,121,358 | B2 | 10/2006 | Gass et al. | |
| 7,124,839 | B2 | 10/2006 | Furuta et al. | |
| 7,131,503 | B2 | 11/2006 | Furuta et al. | |
| 7,156,191 | B2 * | 1/2007 | Lau | 173/216 |
| 7,201,235 | B2 | 4/2007 | Umemura et al. | |
| 7,207,393 | B2 | 4/2007 | Clark, Jr. et al. | |
| 7,213,659 | B2 | 5/2007 | Saito et al. | |
| 7,216,749 | B2 | 5/2007 | Droste | |
| 7,223,195 | B2 | 5/2007 | Milbourne et al. | |
| 7,225,884 | B2 | 6/2007 | Aeberhard | |
| 7,249,638 | B2 | 7/2007 | Bodine et al. | |
| 7,306,049 | B2 | 12/2007 | Soika et al. | |
| 7,308,948 | B2 | 12/2007 | Furuta | |
| 7,314,097 | B2 | 1/2008 | Jenner et al. | |
| 7,322,427 | B2 | 1/2008 | Shimma et al. | |
| 7,328,752 | B2 | 2/2008 | Gass et al. | |
| 7,331,408 | B2 | 2/2008 | Arich et al. | |
| 7,331,496 | B2 | 2/2008 | Britz et al. | |
| 7,410,007 | B2 | 8/2008 | Chung et al. | |
| 2003/0146007 | A1 | 8/2003 | Greitmann | |
| 2004/0245005 | A1 | 12/2004 | Toyama et al. | |
| 2005/0028997 | A1 | 2/2005 | Hagan et al. | |
| 2005/0061521 | A1 | 3/2005 | Saito et al. | |
| 2005/0263303 | A1 | 12/2005 | Shimizu et al. | |
| 2005/0263304 | A1 | 12/2005 | Sainomoto et al. | |
| 2005/0263305 | A1 | 12/2005 | Shimizu et al. | |
| 2006/0006614 | A1 | 1/2006 | Buchholz et al. | |
| 2006/0021771 | A1 | 2/2006 | Milbourne et al. | |
| 2006/0086514 | A1 | 4/2006 | Aeberhard | |
| 2006/0090913 | A1 | 5/2006 | Furuta | |
| 2006/0213675 | A1 | 9/2006 | Whitmire et al. | |
| 2006/0237205 | A1 | 10/2006 | Sia et al. | |
| 2006/0254786 | A1 | 11/2006 | Murakami et al. | |
| 2006/0254789 | A1 | 11/2006 | Murakami et al. | |
| 2006/0266537 | A1 | 11/2006 | Izumisawa | |
| 2007/0056756 | A1 | 3/2007 | Chung et al. | |
| 2007/0068692 | A1 | 3/2007 | Puzio | |
| 2007/0068693 | A1 | 3/2007 | Whitmire et al. | |
| 2007/0074883 | A1 | 4/2007 | Strasser et al. | |
| 2007/0084614 | A1 | 4/2007 | Whitmire et al. | |
| 2007/0174645 | A1 | 7/2007 | Lin | |
| 2007/0181319 | A1 | 8/2007 | Whitmine et al. | |
| 2007/0201748 | A1 | 8/2007 | Bixler et al. | |
| 2007/0266545 | A1 | 11/2007 | Bodine et al. | |
| 2008/0035360 | A1 | 2/2008 | Furuta | |
| 2008/0041602 | A1 | 2/2008 | Furuta | |
| 2008/0308286 | A1 * | 12/2008 | Puzio | 173/210 |
| 2010/0071923 | A1 | 3/2010 | Rudolph et al. | |

FOREIGN PATENT DOCUMENTS

| | | | |
|---|---|---|---|
| DE | 1941093 | A1 | 4/1971 |
| DE | 2557118 | A1 | 6/1977 |
| DE | 4038502 | A1 | 6/1992 |
| DE | 4328599 | A1 | 3/1994 |
| DE | 9404069 | U1 | 6/1994 |
| DE | 9406626 | U1 | 6/1994 |
| DE | 19954931 | A1 | 6/2001 |
| DE | 20209356 | U1 | 10/2002 |
| DE | 20304314 | U1 | 7/2003 |
| DE | 20305853 | U1 | 9/2003 |
| DE | 102004037072 | B3 | 1/2006 |
| EP | 0394604 | A2 | 10/1990 |
| EP | 0404035 | A2 | 12/1990 |
| EP | 0808695 | A2 | 11/1997 |
| EP | 1621290 | A1 | 2/2006 |
| EP | 1652630 | A2 | 5/2006 |
| EP | 1707322 | A1 | 10/2006 |
| GB | 1574652 | A | 9/1980 |
| GB | 2102718 | A | 2/1983 |
| GB | 2274416 | A | 7/1994 |
| GB | 2328635 | A | 3/1999 |
| GB | 2334909 | A | 9/1999 |
| GB | 2404891 | A | 2/2005 |
| JP | 62173180 | A | 7/1987 |
| JP | 62297007 | A | 12/1987 |
| JP | 63123678 | A | 5/1988 |
| JP | 2139182 | A | 5/1990 |
| JP | 2284881 | A | 11/1990 |
| JP | 3043164 | A | 2/1991 |
| JP | 3168363 | A | 7/1991 |
| JP | 6010844 | A | 1/1994 |
| JP | 6023923 | A | 2/1994 |
| JP | 6182674 | A | 7/1994 |
| JP | 6210507 | A | 8/1994 |
| JP | 6215085 | A | 8/1994 |
| JP | 07040258 | A | 2/1995 |
| JP | 7080711 | A | 3/1995 |
| JP | 7328955 | A | 12/1995 |
| JP | 9136273 | A | 5/1997 |
| JP | 9239675 | A | 9/1997 |
| JP | 10291173 | A | 11/1998 |
| JP | 3655481 | A | 8/2000 |
| JP | 2000233306 | A | 8/2000 |
| JP | 2000246659 | A | 9/2000 |
| JP | 2001009746 | A | 1/2001 |
| JP | 2001088051 | A | 4/2001 |
| JP | 2001088052 | A | 4/2001 |
| JP | 2001105214 | A | 4/2001 |
| JP | 2002059375 | A | 2/2002 |
| JP | 2002178206 | A | 6/2002 |
| JP | 2002224971 | A | 8/2002 |
| JP | 2002273666 | A | 9/2002 |
| JP | 2003071745 | A | 3/2003 |
| JP | 2003220569 | A | 8/2003 |
| JP | 2004130474 | A | 4/2004 |
| JP | 2005052904 | A | 3/2005 |
| JP | 2006123081 | A | 5/2006 |
| JP | 2006175562 | A | 7/2006 |
| WO | WO-9521039 | A1 | 8/1995 |
| WO | WO-2007135107 | A1 | 11/2007 |

* cited by examiner

POWER TOOL WITH IMPACT MECHANISM

CROSS-REFERENCE TO RELATED APPLICATIONS

This application claims the benefit and priority of U.S. Provisional Patent Application No. 61/174,143 filed Apr. 30, 2009. The entire disclosure of the above application is incorporated herein by reference.

INTRODUCTION

The present invention generally relates to power tools having an impact mechanism.

U.S. Pat. Nos. 7,395,873, 7,053,325, 7,428,934, 7,124,839 and Japanese publications JP 6-182674, JP 7-148669, JP 2001-88051 and JP 2001-88052 disclose various types of power tools having an impact mechanism. While such tools can be effective for their intended purpose, there remains a need in the art for an improved impact mechanism and an improved power tool with an impact mechanism.

SUMMARY

This section provides a general summary of some aspects of the present disclosure and is not a comprehensive listing or detailing of either the full scope of the disclosure or all of the features described therein.

In one form, the present teachings provide a power tool with a housing, a motor, a transmission, a spindle and an impact mechanism. The motor has an output shaft that drives the transmission. The transmission has a plurality of planet gears, a planet carrier journally supporting the planet gears for rotation about an axis, and a ring gear that is in meshing engagement with the planet gears. The impact mechanism has a plurality of anvil lugs, an impactor and an impactor spring. The anvil lugs are coupled to the ring gear and are not engaged by the planet gears. The impactor is mounted to pivot about the spindle and has a plurality of hammer lugs. The impactor spring biases the impactor toward the ring gear to cause the hammer lugs to engage the anvil lugs.

In another form, the present teachings provide power tool with a motor, a spindle, a transmission, a rotary impact mechanism and an adjustment mechanism. The transmission is driven by the motor and has a transmission output. The rotary impact mechanism cooperates with the transmission to drive the spindle. The rotary impact mechanism includes a plurality of anvil lugs, an impactor, and a spring. The impactor is movable axially and pivotally on the spindle and includes a plurality of hammer lugs. The spring biases the impactor in a predetermined axial direction to cause the hammer lugs to engage the anvil lugs. The rotary impact mechanism is operable in a direct drive mode in which the hammer lugs and the anvil lugs remain engaged to one another and a rotary impact mode in which the impactor reciprocates and pivots to permit the hammer lugs to repetitively engage and disengage the anvil lugs and thereby generate a rotary impulse. The adjustment mechanism is configured to set a switching torque at which the rotary impact mechanism will switch between the direct drive mode and the rotary impact mode.

In yet another form, the present teachings provide a power tool having a motor, a transmission, a shaft and an impact mechanism. The transmission is driven by an output shaft of the motor and includes a planetary stage with a ring gear and a planetary stage output member. The shaft coupled to the planetary stage output member. The impact mechanism has a first set of impacting lugs, an impactor and an impactor spring. The first set of impacting lugs are fixed to the ring gear. The impactor is rotatably mounted on the shaft and includes a second set of impacting lugs. The impactor spring biases the impactor toward the ring gear to cause the second impacting lugs to engage the first impacting lugs. The impact mechanism is operable in a first mode in which the second impacting lugs repetitively cam over the first impacting lugs to urge the impactor axially away from the ring gear in response to application of a reaction torque to the ring gear that exceeds a predetermined threshold and thereafter re-engage the first impacting lugs to create a torsional impulse that is applied to the ring gear and which is greater in magnitude than the predetermined threshold. The impact mechanism is also being operable in a second mode in which the second impacting lugs are not permitted to cam over and disengage the first impacting lugs irrespective of the magnitude of the reaction torque applied to the ring gear.

In yet another form, the present teachings provide a power tool having a motor, a shaft, a transmission, a rotary impact mechanism, a housing, which houses the transmission and the rotary impact mechanism, and an adjustment mechanism. The transmission is driven by an output shaft of the motor. The rotary impact mechanism cooperates with the transmission to drive the shaft. The rotary impact mechanism includes a first set of impacting lugs, an impactor and an impactor spring. The impactor being rotatably mounted on the shaft and includes a second set of impacting lugs. The impactor spring biases the impactor in a direction toward the first set of impacting lugs to cause the second impacting lugs to engage the first impacting lugs. The impact mechanism is operable in a first mode in which the second impacting lugs repetitively cam over the first impacting lugs to urge the impactor axially away from the first impacting lugs in response to application of a trip torque and thereafter axially toward the first impacting lugs to re-engage the first impacting lugs and create a torsional impulse that is applied to the shaft. The adjustment mechanism is configured for setting the trip torque at one of a plurality of predetermined levels and includes an adjusting member that is mounted for rotation for rotation on the housing about the shaft, the adjustment member forming at least a portion of an exterior surface of the power tool.

In another form the present teachings provide a method for installing a self-drilling, self-tapping (SDST) screw to a workpiece. The method includes: driving the SDST screw with a rotary power tool with a continuous rotary motion against a first side of the workpiece to form a hole in the workpiece; operating the rotary power tool with rotating impacting motion to complete the formation of the hole through a second, opposite side of the workpiece, to rotate the SDST screw to form at least one thread in the workpiece or both; and operating the power tool with continuous rotary motion to tighten the SDST screw to the workpiece.

In a further form the present teachings provide a power tool that includes a motor, an output spindle, a transmission and an impact mechanism. The transmission and the impact mechanism cooperate to drive the output spindle in a continuous rotation mode and in a rotary impacting mode. A trip torque for changing between the continuous rotation mode and the rotary impacting mode occurs when a continuous torque greater than or equal to 0.5 Nm and less than or equal to 2 Nm is applied to the output spindle. In the rotary impacting mode torque spikes greater than or equal to 0.2 J and less than or equal to 5.0 J are cyclically applied to the output spindle.

Further areas of applicability will become apparent from the description provided herein. It should be understood that the description and specific examples in this summary are intended for purposes of illustration only and are not intended to limit the scope of the present disclosure, its application and/or uses in any way.

BRIEF DESCRIPTION OF THE DRAWINGS

The drawings described herein are for illustrative purposes only and are not intended to limit the scope of the present disclosure in any way. The drawings are illustrative of selected teachings of the present disclosure and do not illustrate all possible implementations. Similar or identical elements are given consistent identifying numerals throughout the various figures.

DETAILED DESCRIPTION OF THE VARIOUS EMBODIMENTS

Figure 1:
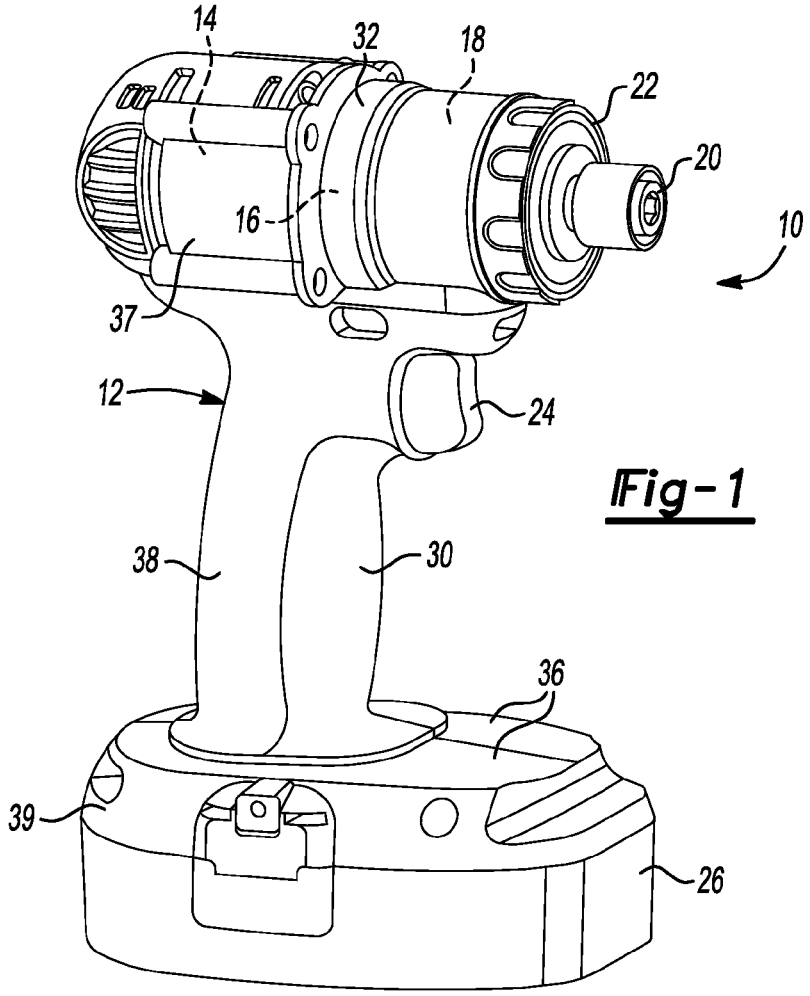
FIG. 1 is a perspective view of an exemplary power tool constructed in accordance with the teachings of the present disclosure.

With reference to FIG. 1 of the drawings, a power tool constructed in accordance with the teachings of the present disclosure is generally indicated by reference numeral 10. With additional reference to FIGS. 2 and 3, the rotary power tool 10 can include a housing assembly 12, a motor assembly 14, a transmission 16, an impact mechanism 18, an output spindle 20, a torque adjustment mechanism 22, a conventional trigger assembly 24 and a conventional battery pack 26. It will be appreciated that while the particular power tool described herein and illustrated in the attached drawings is a battery-powered tool, the teachings of the present disclosure have application to AC powered tools, as well as to pneumatic and hydraulic powered tools as well.

Referring to FIG. 1, the housing assembly 12 can include a handle housing 30 and a gear case 32. The handle housing 30 can include a pair of clam shell housing halves 36 that can be coupled together in a conventional manner to define a motor housing 37, a handle 38 and a battery pack mount 39 that can be configured in a manner that facilitates both the detachable coupling of the battery pack 26 to the handle housing 30 and the electrical coupling of the battery pack 26 to the trigger assembly 24. The motor housing 37 can be configured to house the motor assembly 14 and can include a pair of motor mounts (not shown). The trigger assembly 24 can be mounted to the handle housing 30 and can electrically couple the battery pack 26 to the motor assembly 14 in a conventional manner. The gear case 32 can be coupled to the handle housing 30 to close a front opening in the handle housing 30 and can support the transmission 16, impact mechanism 18 and output spindle 20.

Figure 2:
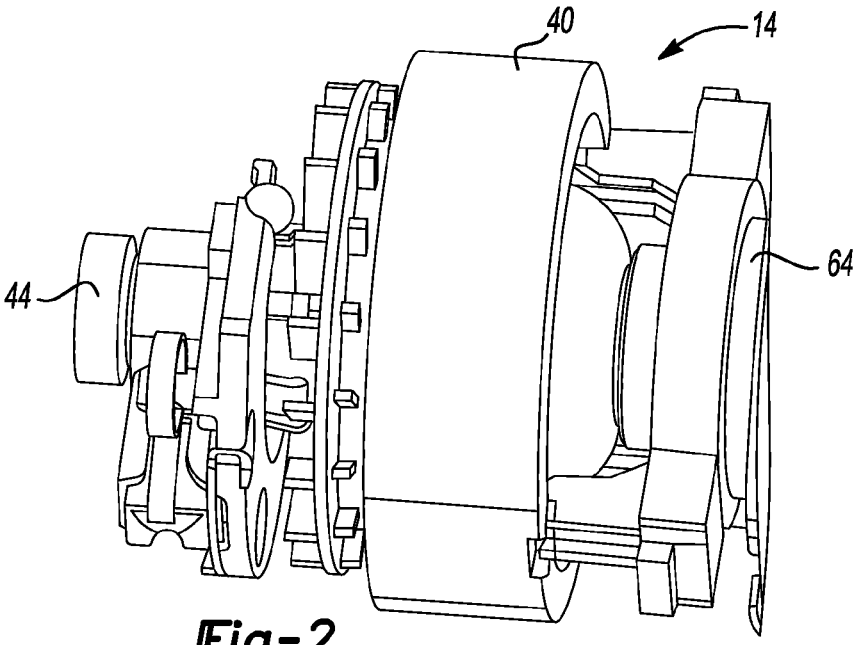
FIG. 2 is a perspective view of a portion of the power tool of FIG. 1 illustrating the motor assembly in more detail.

Referring to FIGS. 1 and 2, the motor assembly 14 can include an electric motor 40 that can be received in the motor housing 37. The electric motor 40 can have an output spindle 42 (FIG. 4) that can be supported for rotation on the motor mounts (not shown) by a motor bearing 44. In the particular example provided, the electric motor 40 is a brushed, frameless DC electric motor, but it will be appreciated that other types of electric motors could be employed.

Figure 3:
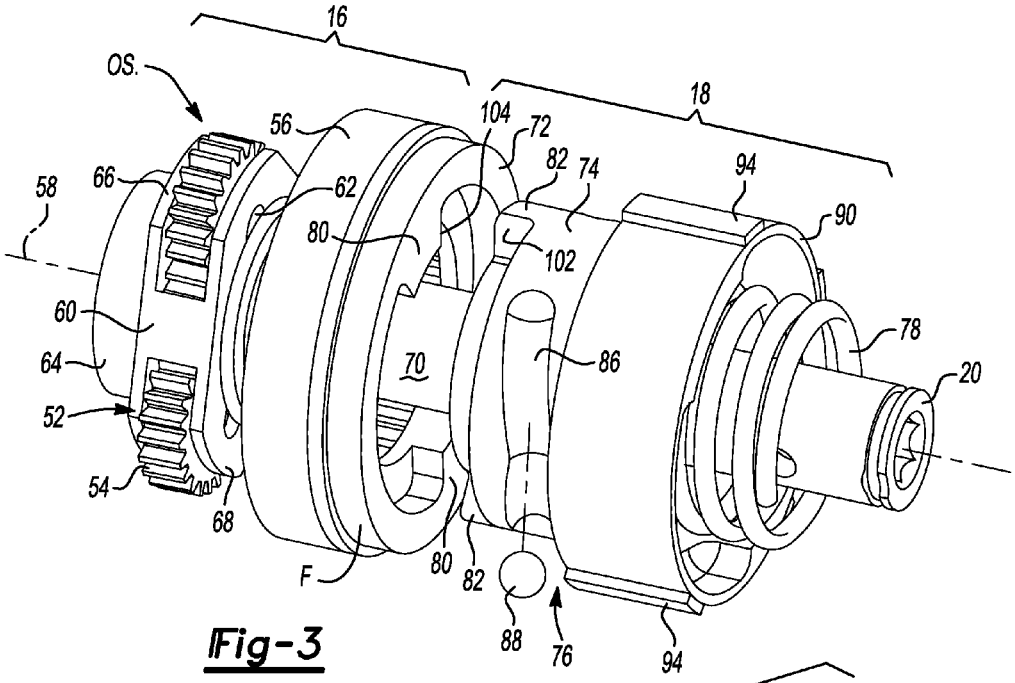
FIGS. 3 and 4 are perspective views of a portion of the power tool of FIG. 1 illustrating the transmission, impact mechanism and output spindle in more detail.
Figure 4:
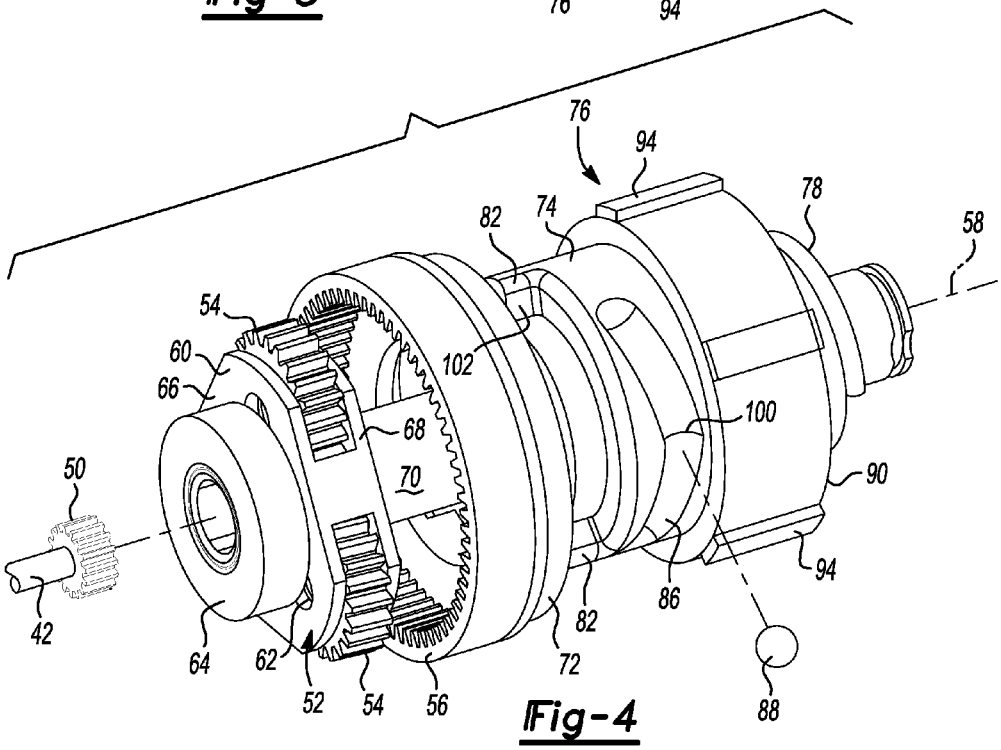

With reference to FIGS. 3 and 4, the transmission 16 can include one or more stages (which includes an output stage) and can be configured to provide one or more different speed reductions between an input of the transmission 16 and an output of the transmission 16. In the particular example provided, the transmission 16 is a single-stage (i.e., consists solely of an output stage OS), single-speed planetary transmission having a sun gear 50 (i.e., the transmission input in the example provided), a planet carrier 52 (i.e., the transmission output in the example provided), a plurality of planet gears 54, and a ring gear 56. The sun gear 50 can be mounted or coupled to the output spindle 42 of the electric motor 40 (FIG. 2). The planet carrier 52 can be rotatable about an axis 58 and can include a carrier structure 60, a plurality of carrier pins 62 and a carrier bearing 64 that can support the carrier structure 60 on the housing assembly 12 (FIG. 1) or the motor assembly 14 (FIG. 2) as desired for rotation about the axis 58. The carrier structure 60 can include a rear plate member 66 and a front plate member 68 that are axially spaced from one another and through which the pins 62 can extend. Each of the planet gears 54 can be mounted for rotation on an associated one of the pins 62 and can be meshingly engaged with the sun gear 50 and the ring gear 56.

The impact mechanism 18 can include a rotary shaft 70, an anvil 72, an impactor 74, a cam mechanism 76 and an impactor spring 78. The rotary shaft 70 can be coupled to the output of the transmission 16 (i.e., the planet carrier 52 in the example provided) for rotation about the axis 58. In the particular example provided, the rotary shaft 70 is unitarily formed with the carrier structure 60 and the output spindle 20, but it will be appreciated that two or more of these components could be separately formed and assembled together. The anvil 72 can comprise a set of anvil lugs 80 that can be coupled to the ring gear 56 in an appropriate manner, such as on a side or end that faces the impactor 74 or on the circumference of the ring gear 56. Although the set of anvil lugs 80 is depicted in the accompanying illustrations as comprising two discrete lugs that are formed on a flange F that extends axially from the ring gear 56, it will be appreciated that the set of anvil lugs 80 could comprise a single lug or a multiplicity of lugs in the alternative and/or that the lug(s) could extend radially inwardly or outwardly from the ring gear 56. The anvil lugs 80 are coupled to the ring gear 56 and are not engaged by the planet gears 54.

The impactor 74 can be an annular structure that can be mounted co-axially on the rotary shaft 70. The impactor 74 can include a set of hammer lugs 82 that can extend rearwardly toward the ring gear 56. Although the set of hammer lugs 82 is depicted in the accompanying illustrations as comprising two discrete lugs, it will be appreciated that the set of hammer lugs 82 could comprise a single lug or a multiplicity of lugs in the alternative and that the quantity of lugs in the set of hammer lugs 82 need not be equal to the quantity of lugs in the set of anvil lugs 80. Aside from contact with the set of anvil lugs 80 that are coupled to the ring gear 56, the impactor 74 is not configured to engage other elements of the transmission 16 and does not meshingly engage any geared element(s) of the transmission 16.

The cam mechanism 76 can be configured to permit limited rotational and axial movement of the impactor 74 relative to the gear case 32 (FIG. 1). In the example provided, the cam mechanism 76 includes a helical cam groove 86 the is formed into the impactor 74 about its exterior circumferential surface, a cam ball 88, which is received into the cam groove 86, and an annular retention collar 90 that is disposed about the impactor 74 and which maintains the cam ball 88 in the cam groove 86. The retention collar 90 can be non-rotatably coupled to the gear case 32 (FIG. 1) and in the particular example provided, includes a plurality of longitudinally-extending, circumferentially spaced-apart ribs 94 that are received into corresponding grooves (not shown) formed into the gear case 32 (FIG. 1). It will be appreciated, however, that the particular cam mechanism 76 illustrated is merely exemplary and is not intended to limit the scope of the disclosure. Other types of cam mechanisms, including mating threads formed on the impactor 74 and the retention collar 90, could be employed in the alternative to control/limit the rotational and axial movement of the impactor 74. One or more retaining rings (not shown) or other device(s) can be coupled to the gear case 32 (FIG. 1) to inhibit axial movement of the retention collar 90 along the axis 58.

Figure 5:
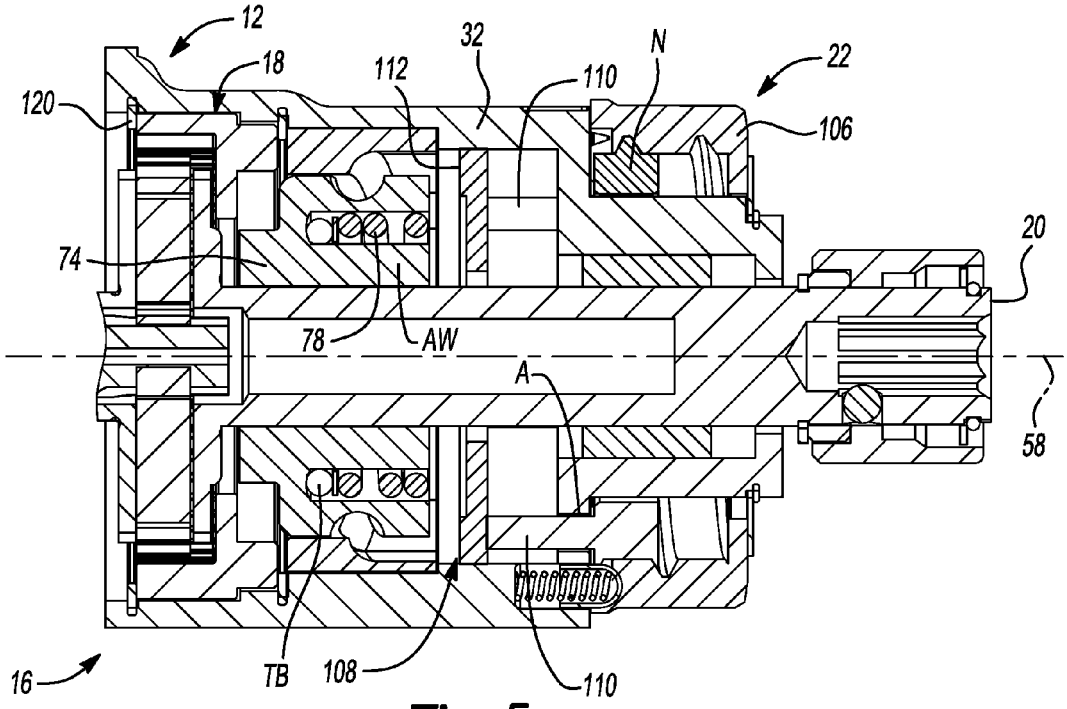
FIG. 5 is a side, partly sectioned view of a portion of the power tool of FIG. 1 illustrating the transmission, impact mechanism, torque adjustment mechanism and output spindle, with the torque adjustment collar of the torque adjustment mechanism being disposed in a first position.

With additional reference to FIG. 5, the impactor spring 78 can bias the impactor 74 rearwardly such that the cam ball 88 is received in the end 100 of the cam groove 86 and radial flanks 102 of the hammer lugs 82 are engaged to corresponding radial flanks 104 on the anvil lugs 80. The impactor spring 78 can be a compression spring and can be received between the housing assembly 12 and the impactor 74. A thrust bearing TB (FIG. 5) can be employed between the impactor spring 78 and the housing assembly 12 and/or between the impactor spring 78 and the impactor 74. In the particular example provided, the impactor 74 defines an annular wall AW (FIG. 5) that is spaced radially apart from the output spindle 20 so as to define an annular pocket P (FIG. 5) in the impactor 74 into which the impactor spring 78 is received.

Figure 6:
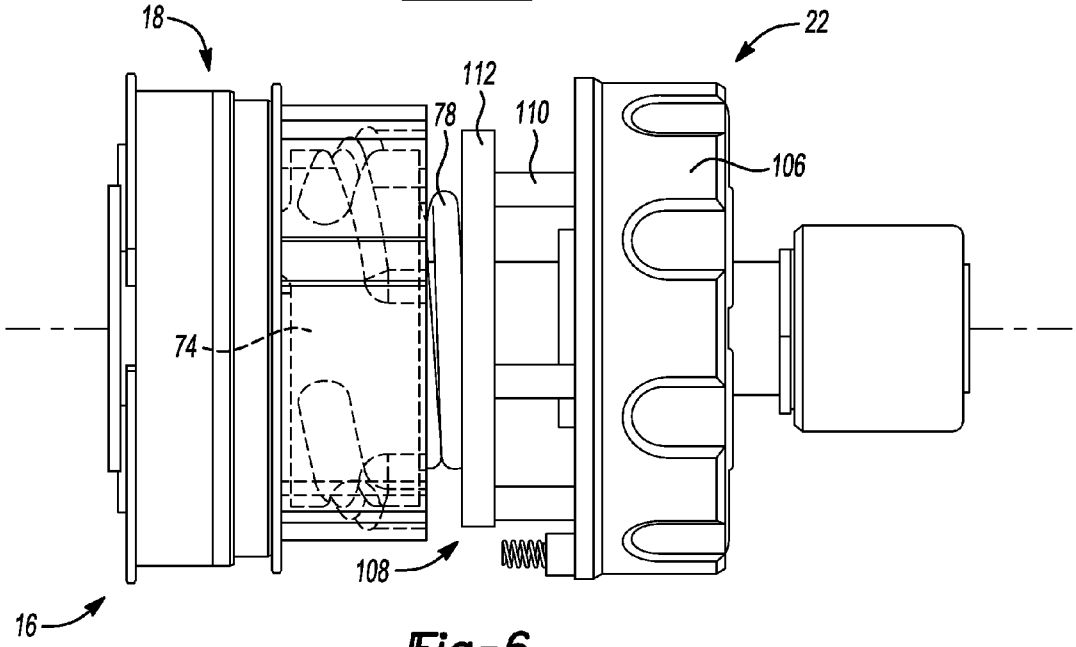
FIG. 6 is a side view similar to that of FIG. 5 but illustrating the torque adjustment collar in a second position.
Figure 13:
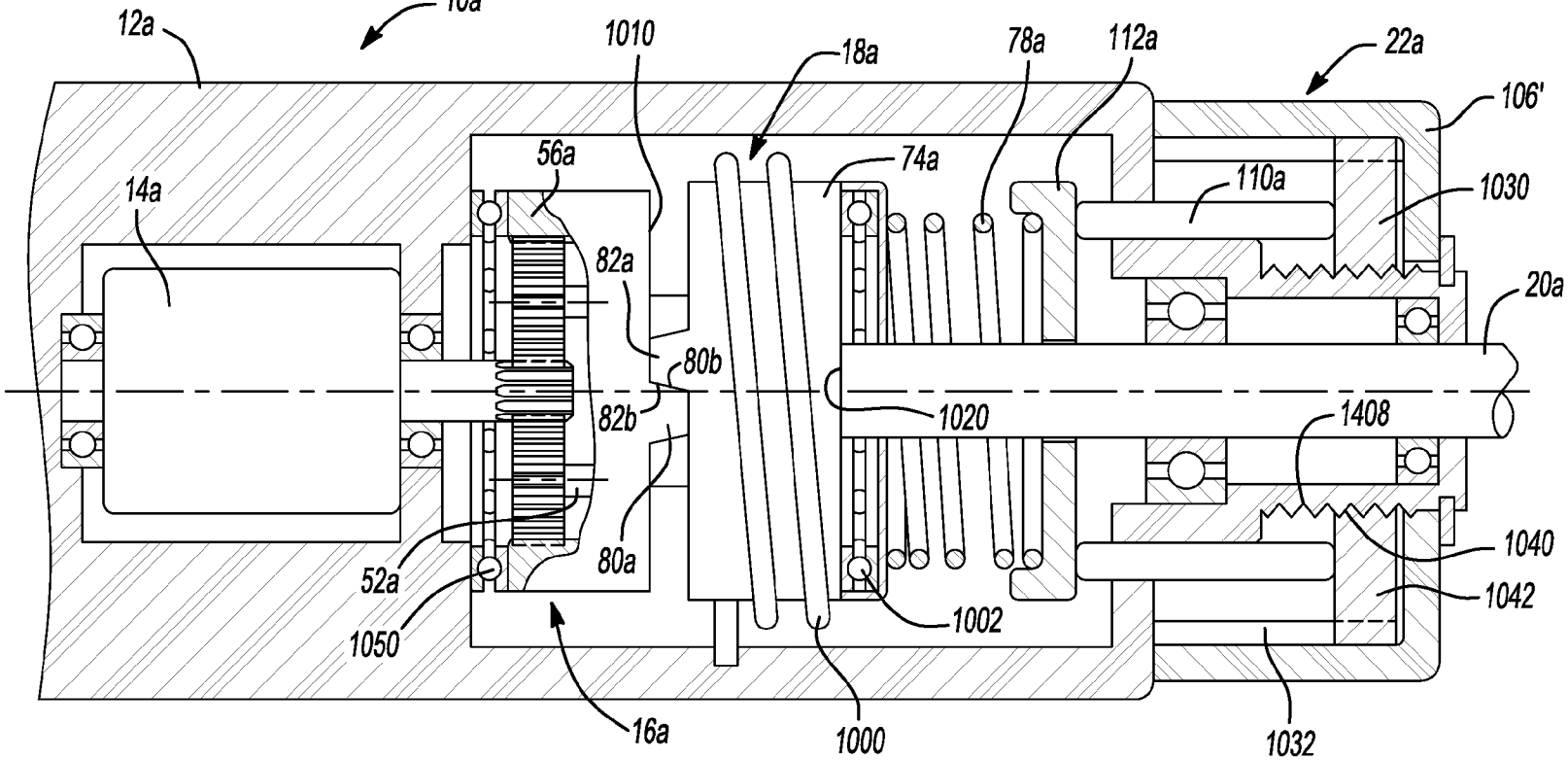
FIG. 13 is a section view of a portion of another power tool constructed in accordance with the teachings of the present disclosure.
Figure 14:
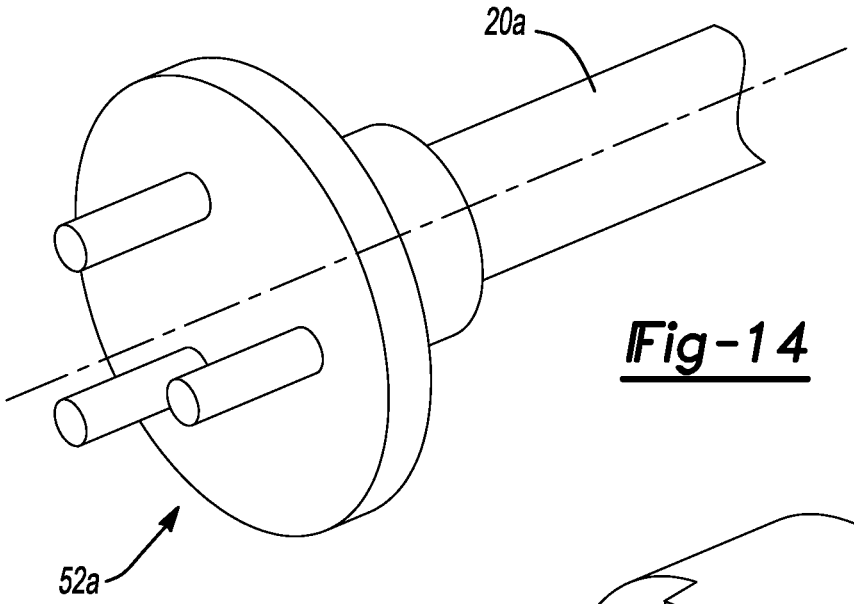
FIG. 14 is a perspective view of a portion of the power tool of FIG. 13, illustrating the transmission output and the output spindle in more detail.
Figure 15:
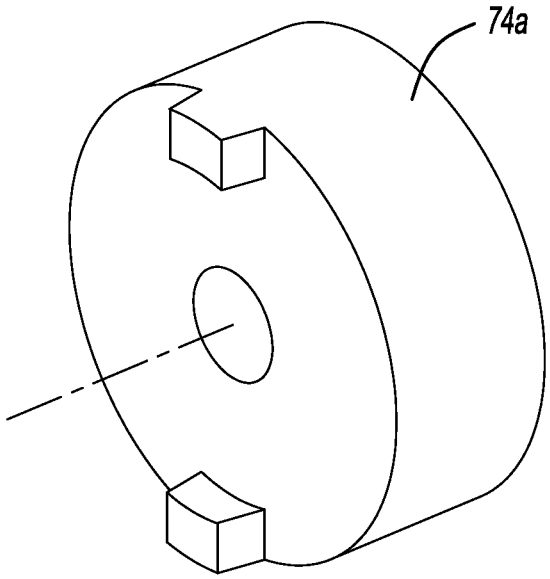
FIG. 15 is a perspective view of a portion of the power tool of FIG. 13, illustrating the impactor of the impact mechanism in more detail.
Figure 16:
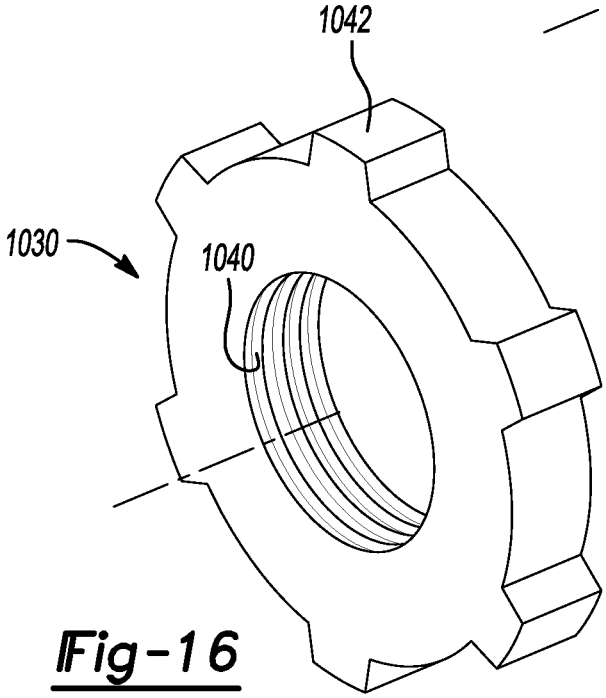
FIG. 16 is a perspective view of a portion of the power tool of FIG. 13, illustrating the adjustment nut of the torque adjustment mechanism in more detail.

With reference to FIG. 5, the torque adjustment mechanism 22 can be generally similar in construction and operation to the torque adjustment mechanism 22*a* described below and illustrated in FIG. 13. Briefly, the torque adjustment mechanism 22 can include a torque adjustment collar 106 and an adjuster 108. The torque adjustment collar 106 can be rotatably mounted on the gear case 32 but maintained in a stationary position along the axis 58 (e.g., the torque adjustment collar 106 can be mounted for rotation on the housing assembly 12 concentric with the output spindle 20). The adjuster 108 can include threaded adjustment nut N, a plurality of legs 110 and a spring plate 112 that can be received in the gear case 32 and disposed between the impactor spring 78 and the legs 110. The threaded adjustment nut N may be integrally formed with the plurality of legs 110 and can be threadably engaged to the torque adjustment collar 106 as shown, or may be threadably engaged to the gear case 32. The legs 110 can be cylindrically shaped and can have a flat end that can abut the spring plate 112. The legs 110 can be received in and extend through discrete apertures A formed in the gear case 32. Accordingly, it will be appreciated that the torque adjustment collar 106 can be rotated between a first position, which is shown in FIG. 5, and a second position, which is shown in FIG. 6 to vary the compression of the impactor spring 78 and therefore a trip torque of the impact mechanism 18 (i.e., a torque at which the impactor 74 disengages the anvil lugs 80). In the first position, the threaded adjustment nut N is positioned so as to cause the legs 110 and the spring plate 112 to compress the impactor spring 78 by a first amount to thereby apply a first axial load is applied to the impactor 74, and in the second position, the threaded adjustment nut N is positioned axially closer to the impactor 74 so as to cause the legs 110 and the spring plate 112 to compress the impactor spring 78 by a second, larger amount to thereby apply a second, relatively higher axial load is applied to the impactor 74. As those of ordinary skill in the art will appreciate from the above discussion, the trip torque may be varied between the trip torque that is associated with the placement of the legs 110 and the spring plate 112 (hereinafter referred to as simply "the adjuster 108") in the first position and the trip torque that is associated with the placement of the adjuster 108 in the second position. For example, the trip torque may be increased (e.g., from the trip torque associated with the positioning of the adjuster 108 at the first position) to a desired level (up to the level dictated by the second position) by rotating the torque adjustment collar 106 to translate the adjuster 108 in a direction toward the second position to further compress the impactor spring 78 such that the impact mechanism 18 will operate at the desired trip torque. As another example, the trip torque may be decreased (e.g., from the trip torque associated with the positioning of the adjuster 108 at the second position) to a desired level (as low as the level dictated by the placement of the adjuster 108 in the first position) by rotating the torque adjustment collar 106 to translate the adjuster 108 in a direction toward the first position to lessen the compression of the impactor spring 78 such that the impact mechanism 18 will operate at the desired trip torque.

It will also be appreciated that the torque adjustment mechanism 22 may be configured with a setting at which the hammer lugs 82 (FIG. 3) cannot be disengaged from the anvil lugs 80 (FIG. 3) to cause the impact mechanism 18 and the transmission 16 to operate in a direct drive mode. Various techniques can be employed for this purpose, including: devices that could be employed to limit axial movement of the impactor 74; devices that could be employed to limit rotation of the ring gear 56; and/or the impactor spring 78 may be compressed to an extent where the impactor spring 78 cannot be further compressed by forward movement of the impactor 74 relative to the ring gear 56 to permit the hammer lugs 82 (FIG. 3) to disengage the anvil lugs 80 (FIG. 3). In such mode the hammer lugs 82 and the anvil lugs 80 can remain engaged to one another so that neither the impactor 74 nor the ring gear 56 tend to rotate.

Figure 7:
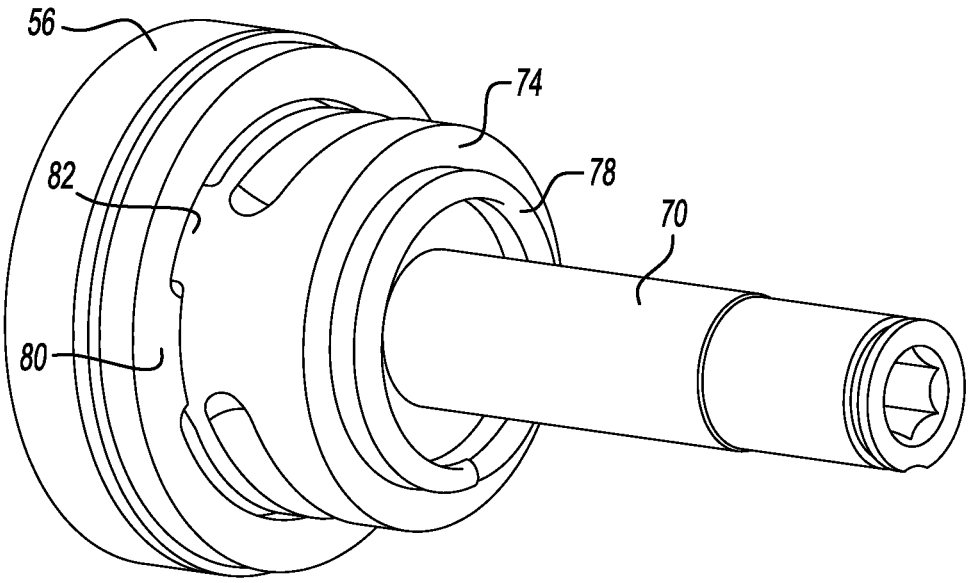
FIGS. 7 through 10 are perspective views of a portion of the power tool of FIG. 1 illustrating the ring gear and the impactor during operation of impact mechanism in a rotary impact mode.
Figure 8:
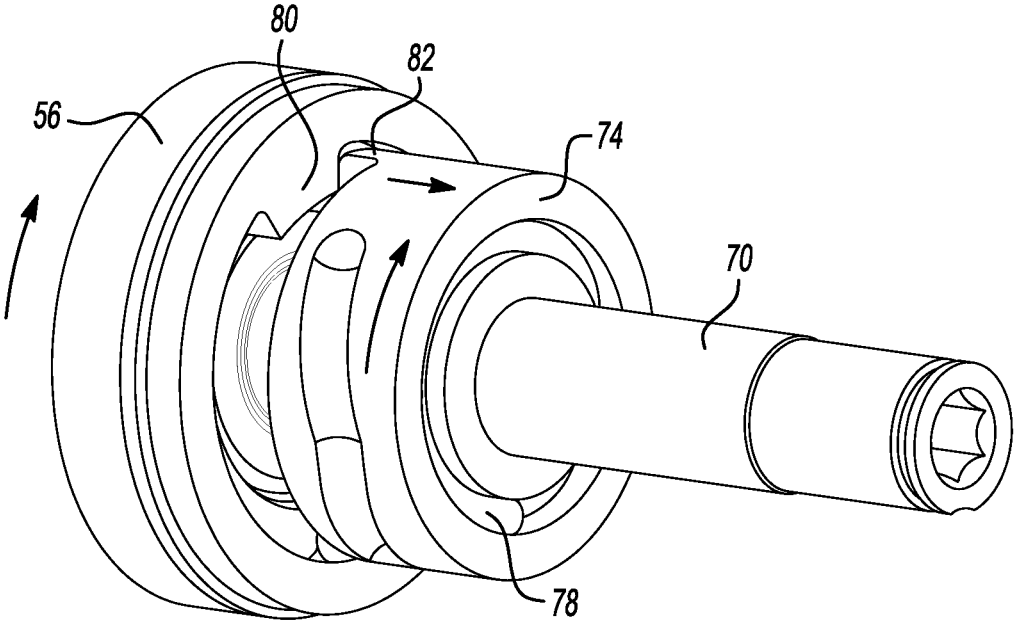
Figure 9:
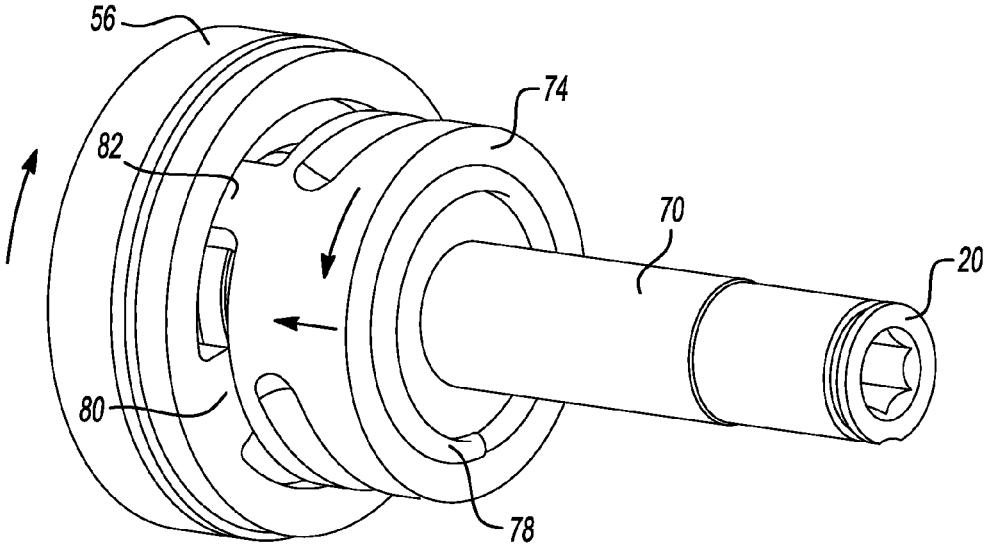
Figure 10:
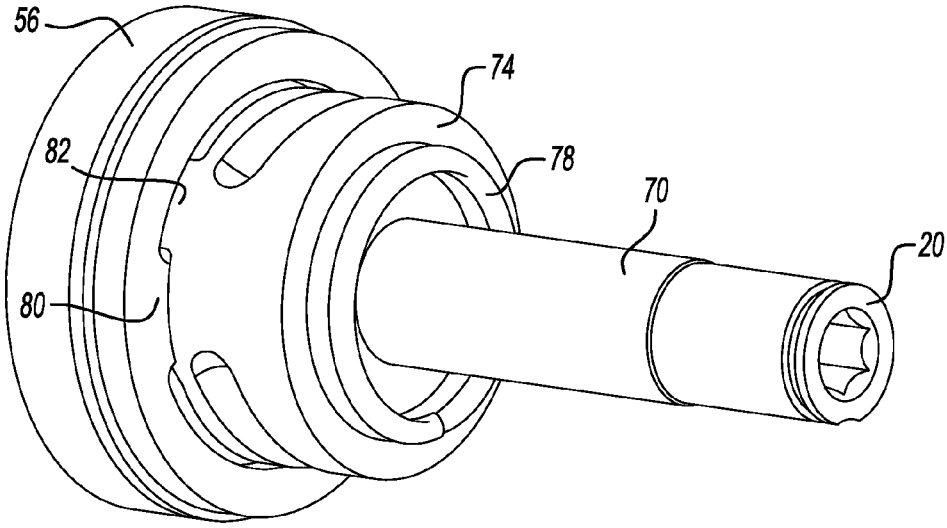
Figure 11:
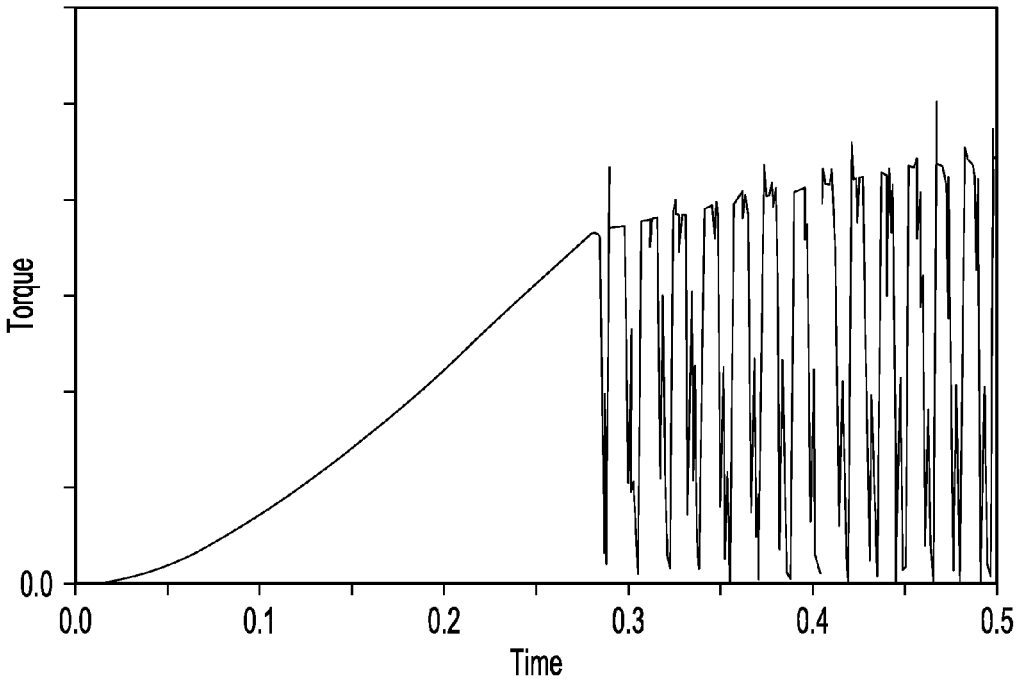
FIG. 11 is a plot illustrating the output torque of the power tool of FIG. 1 as operated in a rotary impact mode.

With reference to FIGS. 3 and 5, the impact mechanism 18 can also be operated in a rotary impact mode in which the impact mechanism 18 cooperates with the transmission 16 to produce a rotationally impacting output. In this mode the torque adjustment collar 106 is positioned in the first position or a position intermediate the first and second position to compress the impactor spring 78 to a point that achieves a desired trip torque; at this point, the impactor spring 78 can be further compressed by forward movement of the impactor 74 so as to permit the hammer lugs 82 to disengage the anvil lugs 80 during operation of the impact mechanism 18. As will be appreciated, disengagement of the hammer lugs 82 and the anvil lugs 80 involves the movement of the impactor 74 in a direction away from the ring gear 56 so as to further compress the impactor spring 78. As torque is transmitted to the output spindle 20 during operation of the rotary power tool 10 (FIG. 1), a torque reaction acts on the ring gear 56, causing it to rotate relative to the (initial) position illustrated in FIG. 7 in a second rotational direction opposite the first rotational direction. Rotation of the ring gear 56 in the second rotational direction causes axial translation of the impactor 74 in a direction away from the ring gear 56 and when the trip torque is exceeded, the hammer lugs 82 will ride or cam over the anvil lugs 80 so that the ring gear 56 disengages the impactor 74 as shown in FIG. 8. At this time, the ring gear 56 is permitted to rotate in the second rotational direction, and the impactor spring 78 will urge the impactor 74 rearwardly to re-engage the ring gear 56 which is illustrated in FIG. 9. The hammer lugs 82 can impact against the anvil lugs 80 when the impactor 74 re-engages the ring gear 56 as shown in FIG. 10 to produce a torsional impulse that is applied to the ring gear 56. It will be appreciated that depending on factors such as the rotational speed of the ring gear 56 and the mass of the impactor 74, the torsional impulse generated by re-engagement of the hammer lugs 82 with the anvil lugs 80 may cause the ring gear 56 to rotate in the first rotational direction, or may merely decelerate the ring gear 56. In this latter situation, it will be appreciated that the ring gear 56 may be halted in its rotation in the second rotational direction, or may merely decelerate as it continues to rotate in the second rotational direction. It will be appreciated that the torsional impulse is transmitted to the output spindle 20 via the planet gears 54 and planet carrier 52 and that because the torsional impulse as applied to the output spindle 20 has a magnitude that exceeds the trip torque, the repetitive engagement and disengagement of the impactor 74 with the ring gear 56 can permit the rotary power tool 10 (FIG. 1) to apply a relatively high torque to a workpiece (e.g., fastener) without transmitting a correspondingly high reaction force to the person holding the rotary power tool 10 (FIG. 1). A plot illustrating the projected torsional output of the rotary power tool 10 (FIG. 1) as a function of time for a given trip torque setting is illustrated in FIG. 11.

Returning to FIGS. 3 and 5, it will be appreciated that as the impactor 74 and impactor spring 78 can apply an axially-directed force to the ring gear 56, a thrust washer or retaining ring 120 (FIG. 5) can be mounted to the gear case 32 (FIG. 1) to inhibit rearward movement of the ring gear 56 along the axis 58 (FIG. 5).

It will also be appreciated that the torque adjustment mechanism 22 can permit the user to select a desired trip torque from a plurality of predetermined trip torques (through rotation of the torque adjustment collar 106). In some situations it may be desirable to initially seat a threaded fastener (not shown) to a desired torque while operating the rotary power tool 10 (FIG. 1) in a non-impacting mode and thereafter employ a rotary impacting mode to fully tighten the threaded fastener. In situations where the fastener may be run in or set without a significant prevailing torque (i.e., in situations where a relatively small torque is required to turn the fastener before the fastener is seated and begins to develop a clamping force), it may be desirable to set the trip torque at a fairly low threshold so as to minimize the torque reaction that is applied to the person holding the rotary power tool 10 (FIG. 1). Where the fastener is subject to a prevailing torque (e.g., in situations where rotation of the fastener forms threads in a workpiece), a fairly low trip torque may not be desirable, particularly if the fastener is relatively long, as operation of the rotary power tool 10 (FIG. 1) in the rotary impact mode to seat the fastener may be somewhat slower than desired in some situations. Rotation of the torque adjustment collar 106 to raise the trip torque may be desirable to cause the rotary power tool 10 (FIG. 1) to remain in the direct drive mode while handling the prevailing torque (e.g., driving the fastener until it is seated) and thereafter switching over to the rotary impact mode (e.g., to tighten the fastener to develop a desired clamping force).

Figure 12:
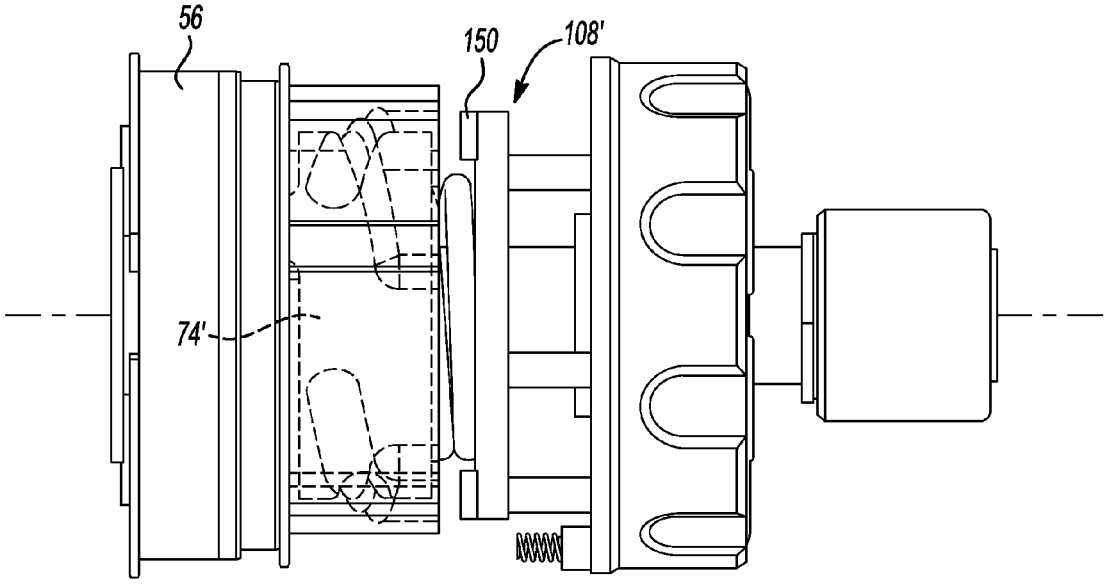
FIG. 12 is a side view of a portion of another power tool constructed in accordance with the teachings of the present disclosure, the view being similar to that of FIG. 5 but illustrating a differently constructed torque adjustment mechanism.

It will be appreciated that other methods and mechanisms may be employed to lock the rotary power tool 10 (FIG. 1) in a direct drive mode. For example, lugs 150 can be coupled to the adjuster 108' as shown in FIG. 12 that can be engaged to corresponding features (not shown), which can be mating lugs or recesses, on the impactor 74' that inhibit rotation of the impactor 74' relative to the adjuster 108'. Since the impactor 74' cannot rotate when the lugs 150 are engaged to the corresponding features on the impactor 74', the hammer lugs 82 (FIG. 3) cannot cam out and ride over the anvil lugs 80 (FIG. 3). Other methods and mechanisms include axially or radially movable pins or gears for maintaining either the ring gear 56 or the impactor 74 (FIG. 3) in a stationary (non-rotating) condition, similar to that which is disclosed in U.S. Pat. No. 7,223,195 for maintaining the ring gears of the transmission in a non-rotating condition. The disclosure of U.S. Pat. No. 7,223,195 is incorporated by reference as if fully set forth in detail herein.

With reference to FIGS. 13 through 16, another power tool constructed in accordance with the teachings of the present disclosure is generally indicated by reference numeral **10*a*. The rotary power tool 10*a* can include a housing assembly 12*a*, a motor assembly 14*a*, a transmission 16*a*, an impact mechanism 18*a*, an output spindle 20*a*, a torque adjustment mechanism 22*a***, a conventional trigger assembly (not shown) and a conventional battery pack (not shown).

The motor assembly **14*a* can be any type of motor (e.g., electric, pneumatic, hydraulic) and can provide rotary power to the transmission 16*a*. The transmission 16*a* can be any type of transmission and can include one or more reduction stages and a transmission output member. In the particular example provided, the transmission 16*a* is a single-stage, single speed planetary transmission and the transmission output member is a planet carrier 52*a*. The output spindle 20*a* can be coupled for rotation with the planet carrier 52*a***.

The impact mechanism **18*a* can include a set of anvil lugs 80*a*, an impactor 74*a*, a torsion spring 1000, a thrust bearing 1002 and an impactor spring 78*a*. The anvil lugs 80*a* can be coupled to a forward annular face 1010 of a ring gear 56*a* that is associated with the transmission 16*a*. The impactor 74*a* can be supported for rotation on the output spindle 20*a* and can include a set of hammer lugs 82*a* that are configured to engage the anvil lugs 80*a*. It will be appreciated that the anvil lugs 80*a* and the hammer lugs 82*a* can be configured in a manner that is similar to the anvil lugs 80** and the hammer lugs 82 discussed above and illustrated in FIG. 3. It will also be appreciated that the anvil lugs 80*a* and the hammer lugs 82*a* can be formed with an appropriate shape that will facilitate the camming out of the anvil and hammer lugs 80*a* and 82*a*. In the particular example provided, the anvil and hammer lugs 80*a* and 82*a* have tapered flanks 80*b* and 82*b*, respectively, that matingly engage one another. The torsion spring 1000 can be coupled to the impactor 74*a* and the housing assembly 12*a* and can bias the impactor 74*a* in a first rotational direction. The thrust bearing 1002 can abut a forward face 1020 of the impactor 74*a*. The impactor spring 78*a* can be received coaxially about the output spindle 20*a* and abutted against the thrust bearing 1002 on a side opposite the impactor 74*a*.

The torque adjustment mechanism 22*a* can include a torque adjustment collar 106', an apply device 108' and an adjustment nut 1030. The adjustment collar 106' can be mounted for rotation on the housing assembly 12*a* and can include a plurality of longitudinally extending grooves 1032 that are circumferentially spaced about its interior surface. The apply device 108' comprises a plurality of legs 110*a* and an annular plate 112*a* in the example provided. The legs 110*a* can extend between the adjustment nut 1030 and the annular plate 112*a*, while the annular plate 112*a* can abut the impactor spring 78*a* on a side opposite the thrust bearing 1002. The adjustment nut 1030 can include a threaded aperture 1040 and a plurality of tabs 1042 that can be received into the grooves 1032 in the torque adjustment collar 106'. The threaded aperture 1040 can be threadably engaged to corresponding threads 1048 formed on the housing assembly 12*a*. Accordingly, it will be appreciated that rotation of the torque adjustment collar 106' can cause corresponding rotation and translation of the adjustment nut 1030 to thereby change the amount by which the impactor spring 78*a* is compressed.

The impact mechanism 18*a* can be operated in a first mode in which the impact mechanism 18*a* does not produce a rotationally impacting output. In this mode the torque adjustment collar 106' is positioned relative to the housing assembly 12*a* to compress the impactor spring 78*a* to a point at which the anvil lugs 80*a* and the hammer lugs 82*a* remain engaged to one another and the impactor 74*a* does not rotate. To counteract the force transmitted through the impactor 74*a* to the ring gear 56*a*, a second thrust bearing 1050 can be disposed between the ring gear 56*a* and the housing assembly 12*a*.

The impact mechanism 18*a* can also be operated in a second mode in which the impact mechanism 18*a* produces a rotationally impacting output. In this mode the torque adjustment collar 106' is positioned relative to the housing assembly 12*a* to compress the impactor spring 78*a* to a point that achieves a desired trip torque; at this point, the impactor spring 78*a* can be further compressed so as to permit the hammer lugs 82*a* to disengage the anvil lugs 80*a* during operation of the impact mechanism 18*a*. As will be appreciated, disengagement of the anvil lugs 80*a* and the hammer lugs 82*a* involves the movement of the impactor 74*a* and the thrust bearing 1002 in a direction away from the ring gear 56*a* so as to further compress the impactor spring 78*a*. As torque is transmitted to the output spindle 20*a* during operation of the rotary power tool 10*a*, a torque reaction acts on the ring gear 56*a*, causing it and the impactor 74*a* to rotate in a second rotational direction opposite the first rotational direction. Rotation of the impactor 74*a* in the second rotational direction loads the torsion spring 1000. When the trip torque is exceeded, the hammer lugs 82*a* will ride or cam over the anvil lugs 80*a* so that the impactor 74*a* disengages the ring gear 56*a*. At this time, the ring gear 56*a* is permitted to rotate in the second rotational direction, the torsion spring 1000 will urge the impactor 74*a* in the first rotational direction and the impactor spring 78*a* will urge the impactor 74*a* rearwardly to re-engage the ring gear 56*a*. The hammer lugs 82*a* impact against the anvil lugs 80*a* when the impactor 74*a* re-engages the ring gear 56*a* to produce a torsional pulse that is applied to the ring gear 56*a* to drive the ring gear 56*a* in the first rotational direction. It is believed that the impactor 74*a* will have sufficient energy not only to stop the ring gear 56*a* as it rotates in the second rotational direction, but also to drive it in the first rotational direction so that the torque output from the transmission 16*a* is a function of the torque that is input to the transmission 16*a* from the motor assembly 14*a*.

Figure 17:
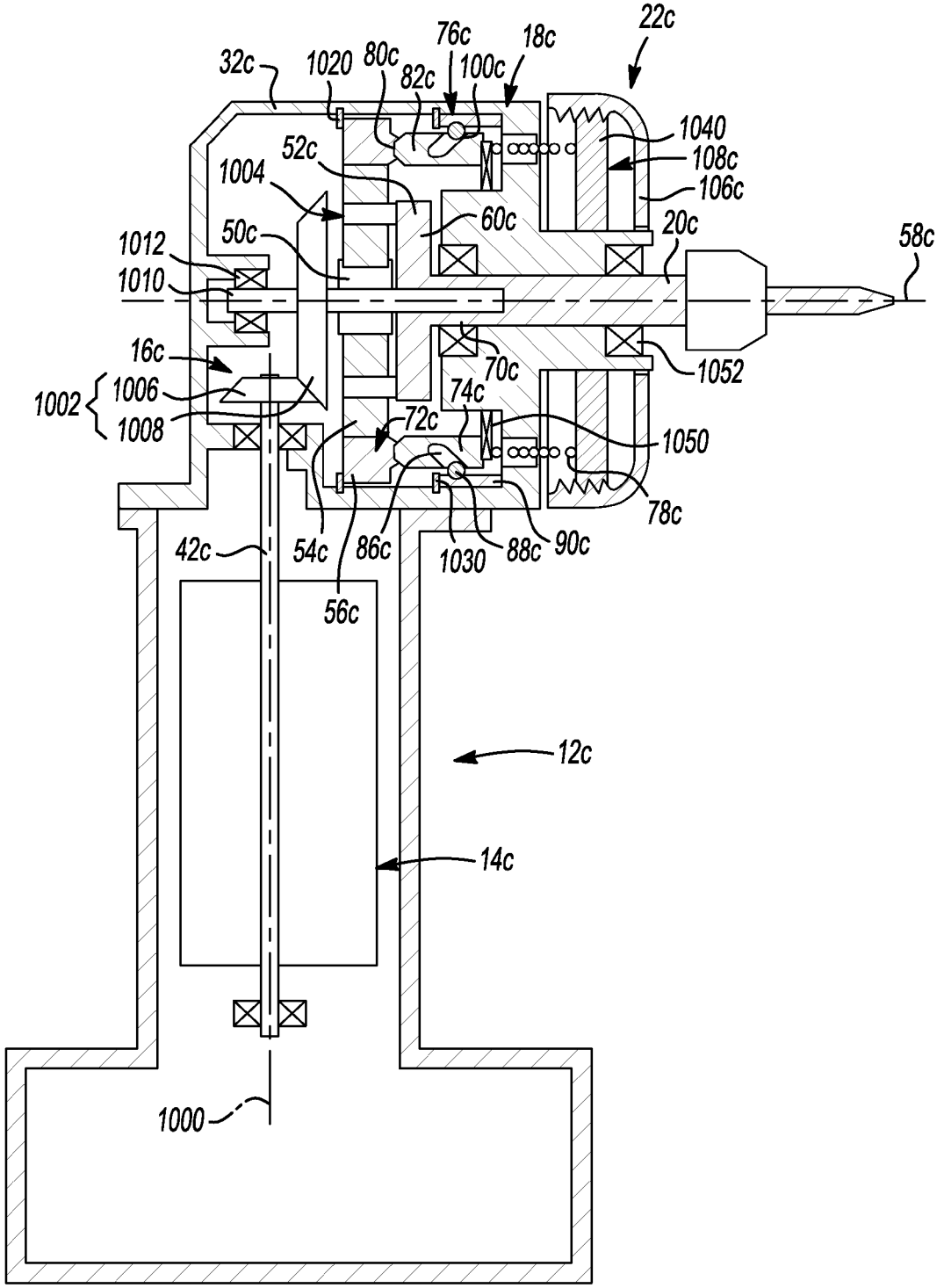
FIG. 17 is a section view of a portion of another power tool constructed in accordance with the teachings of the present disclosure.

While the power tools 10, 10*a* have been illustrated and described thus far as employing an axially arranged motor/transmission/impact mechanism/output spindle configuration, it will be appreciated that the disclosure, in its broadest aspects, can extend to power tools having a motor/transmission/impact mechanism/output spindle configuration that is not arranged in an axial manner. One example is illustrated in FIG. 17 in which the rotary power tool 10*c* has a motor/transmission/impact mechanism/output spindle configuration that is arranged along a right angle. As the example of FIG. 17 is generally similar to the example of FIGS. 1-11 discussed in detail above, reference numerals employed to designate various features and elements associated with the example of FIGS. 1-11 will be employed to designate similar features and elements associated with the example of FIG. 17 but will include a "c" suffix (e.g., the gear case is identified by reference numeral 32 in FIG. 1 and by reference numeral 32*c* in FIG. 17).

The motor assembly 14*c* can be received in the housing assembly 12*c* and disposed about an axis 1000. The transmission 16*c* can include a first stage 1002 and a second stage 1004. The first stage 1002 can include a first bevel gear 1006, which can be coupled for rotation with the output shaft 42*c* of the motor assembly 14*c*, and a second bevel gear 1008 that can be mounted to an intermediate shaft 1010. The intermediate shaft 1010 can be supported on a first end by a bearing 1012 that can be received in the gear case 32*c* and on a second end by the shaft 70*c* of the impact mechanism 18*c*. The second stage 1004 can be a planetary transmission stage with a sun gear 50*c*, a planet carrier 52*c*, a plurality of planet gears 54*c*, and a ring gear 56*c*. A retaining ring 1020 can be employed to inhibit rearward movement of the ring gear 52*c* toward the second bevel gear 1008.

The impact mechanism 18*c* can include a rotary shaft 70*c*, an anvil 72*c*, an impactor 74*c*, a cam mechanism 76*c* and an impactor spring 78*c*. The rotary shaft 70*c* can be coupled to the output of the transmission 16*c* (i.e., the planet carrier 52*c* in the example provided) for rotation about the axis 58*c*. In the particular example provided, the rotary shaft 70*c* is unitarily formed with a carrier structure 60*c* of the planet carrier 52*c* and the output spindle 20*c*, but it will be appreciated that two or more of these components could be separately formed and assembled together. The anvil 72*c* can comprise a set of anvil lugs 80*c* that can be coupled to the ring gear 56*c* on a side or end that faces the impactor 74*c*. The impactor 74*c* can be an annular structure that can be mounted co-axially on the rotary shaft 70*c*. The impactor 74*c* can include a set of hammer lugs 82*c* that can extend rearwardly toward the ring gear 56*c*. The cam mechanism 76*c* can be configured to permit limited rotational and axial movement of the impactor 74*c* relative to the gear case 32*c*. In the example provided, the cam mechanism 76*c* includes a pair of V-shaped cam grooves 86*c* that are formed into the impactor 74*c* about its exterior circumferential surface, a pair of cam balls 88*c*, which are received into respective ones of the cam grooves 86*c*, and an annular retention collar 90*c* that is disposed about the impactor 74*c* and which maintains the cam balls 88*c* in the cam grooves 86*c*. It will be appreciated, however, that any type of cam mechanism can be employed, including mating threads. The retention collar 90*c* can be non-rotatably coupled to the gear case 32*c*. A retaining ring 1030 can be coupled to the gear case 32*c* to inhibit axial movement of the retention collar 90*c* along the axis 58*c*. The impactor spring 78*c* can bias the impactor 74*c* rearwardly such that the cam balls 88*c* are received in the apex 100*c* of the V-shaped cam grooves 86*c* and radial flanks of the hammer lugs 82*c* are engaged to corresponding radial flanks on the anvil lugs 80*c*.

The torque adjustment mechanism 22*c* can be generally similar in construction and operation to the torque adjustment mechanisms 22 and 22*a* described above. Briefly, the torque adjustment mechanism 22*c* can include a torque adjustment collar 106*c* and an adjuster 108*c*. The torque adjustment collar 106*c* can be rotatably mounted on the gear case 32*c* but maintained in a stationary position along the axis 58*c*. The adjuster 108*c* can include an internally threaded adjustment nut 1040 that can be non-rotatably mounted on the gear case 32*c* and threadably engaged to the torque adjustment collar 106*c*. Accordingly, it will be appreciated that rotation of the torque adjustment collar 106*c* can cause corresponding translation of the adjustment nut 104 along the axis 58*c*. A thrust bearing 1050 can be disposed between the impactor spring 78*c* and the impactor 74*c*. Bearings 1052 can be mounted in the gear case 32*c* to support the planet carrier 52*c*, the shaft 70*c* and the output spindle 20*c*.

Figure 18:
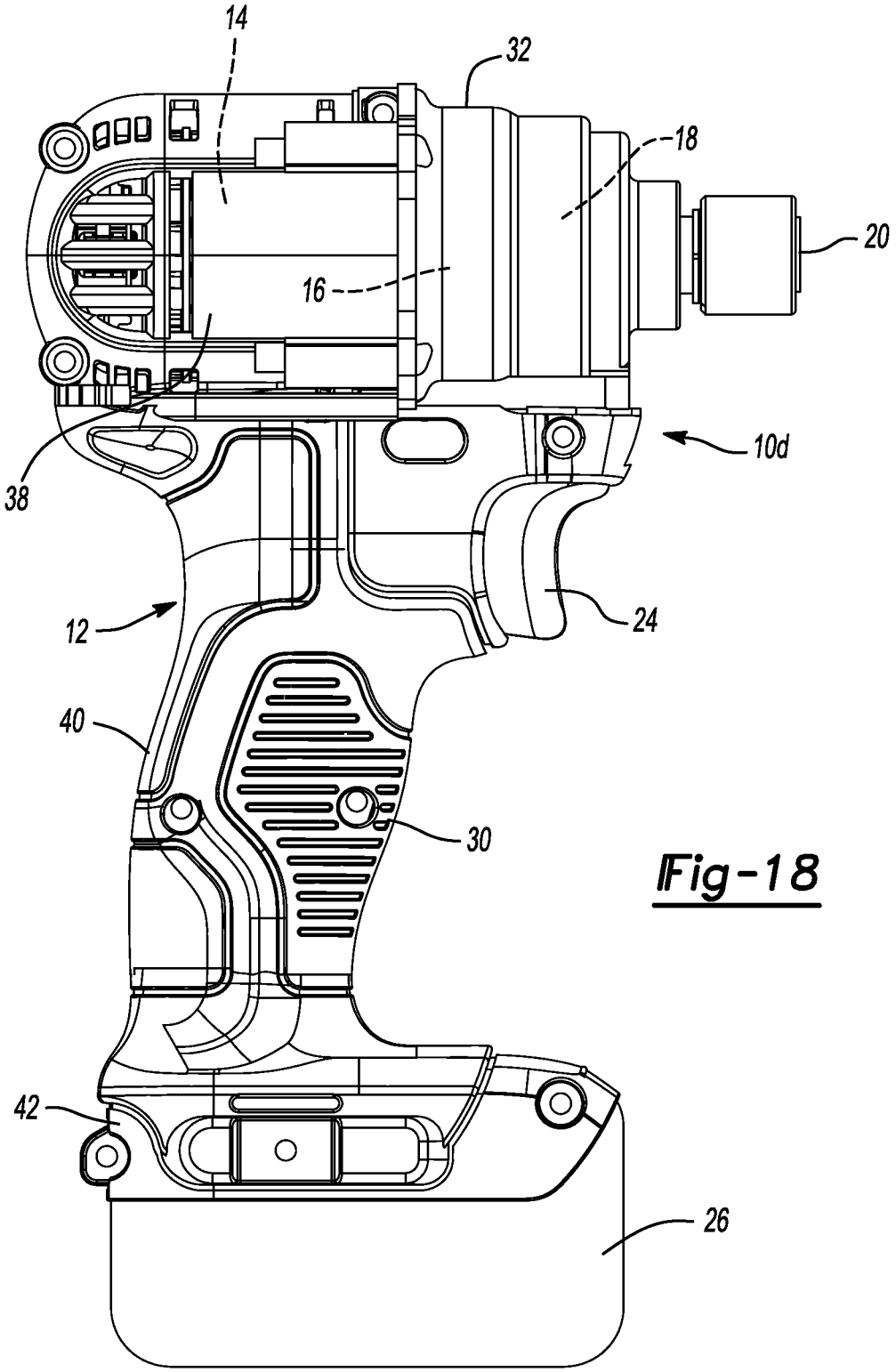
FIG. 18 is a side elevation view of another power tool constructed in accordance with the teachings of the present disclosure.
Figure 19:
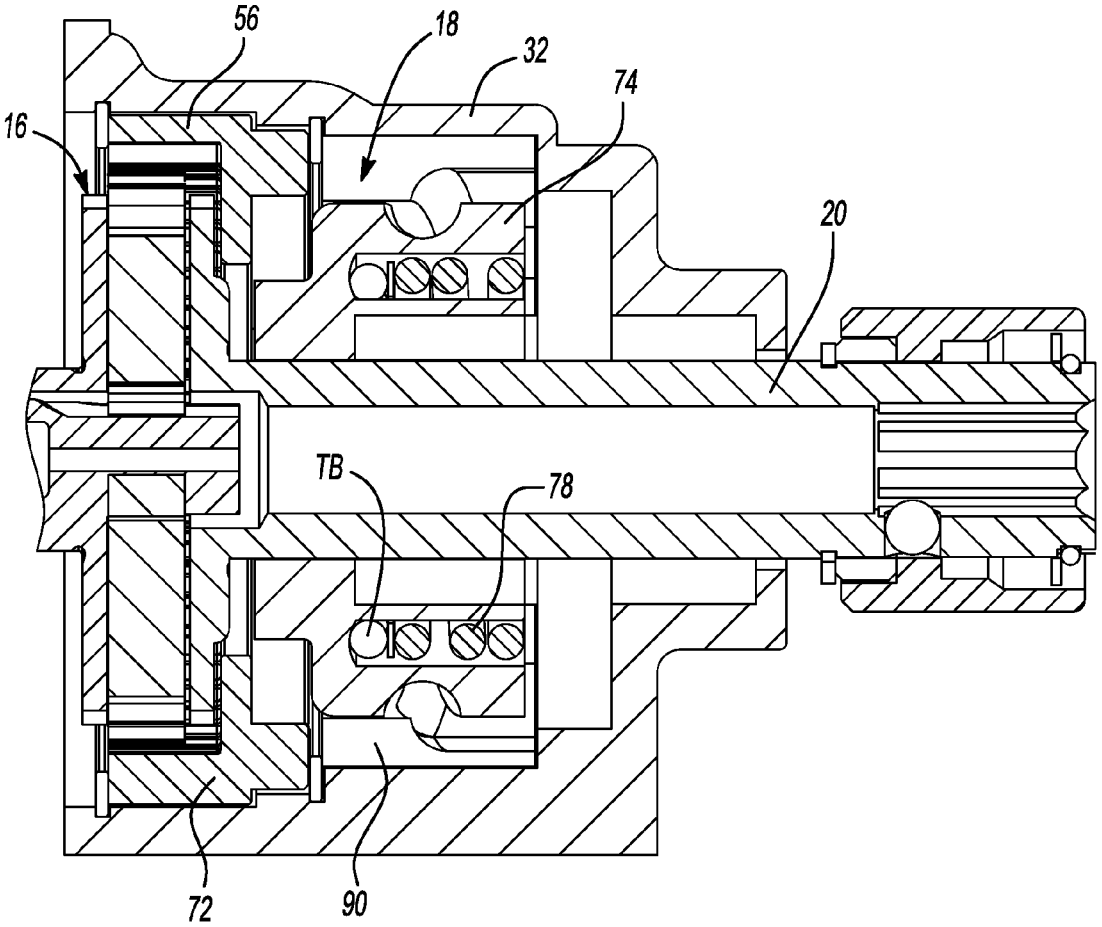
FIG. 19 is a side, partly sectioned view of a portion of the power tool of FIG. 18 illustrating the transmission, impact mechanism, torque adjustment mechanism and output spindle, with the torque adjustment collar of the torque adjustment mechanism being disposed in a first position.

Yet another power tool constructed in accordance with the teachings of the present disclosure is shown in FIGS. 18 and 19 and identified by reference numeral 10*d*. The rotary power tool 10*d* is generally similar to the rotary power tool 10 of FIG. 1, except that the rotary power tool 10*d* does not include any means for adjusting the trip torque (i.e., the trip torque of the rotary power tool 10*d* is preset and non-adjustable). Accordingly, the impactor spring 78 can be abutted directly against the gear case 32 (or against a thrust washer or bearing that may be abutted against the gear case 32). Configuration in this manner renders the rotary power tool 10*d* somewhat shorter and lighter in weight than the rotary power tool 10 of FIG. 1.

The power tools constructed in accordance with the teachings of the present disclosure may be employed to install a self-drilling, self-tapping screw to a workpiece. Non-limiting examples of self-drilling, self-tapping screws are disclosed in U.S. Pat. Nos. 2,479,730; 3,044,341; 3,094,895; 3,463,045; 3,578,762; 3,738,218; 4,477,217; and 5,120,172. Moreover, one type of commercially available self-drilling, self-tapping screw is known in the art as a TEK screw. Those of skill in the art will appreciate that a self-drilling, self-tapping (SDST) screw commonly includes a body, which can have a drilling tip and a plurality of threads, and a head. The drilling tip can be configured to drill or form a hole in a workpiece as the screw is rotated. The threads can be configured to form one or more mating threads in the workpiece as the screw traverses axially into the workpiece. The head can be configured to receive rotary power to drive the screw to thereby form the hole and the threads, as well as to secure the head against the workpiece and optionally to generate tension in a portion of the body (i.e., a clamp force). A power tool constructed in accordance with the teachings of the present disclosure can be configured to drive the head of the SDST screw with a continuous rotary (i.e., non-impacting) motion against a first side of the workpiece to at least partly form a hole in the workpiece. The power tool can be operated to produce rotary impacting motion (which is imparted to the head of the SDST screw) to complete the hole through a second, opposite side of the workpiece and/or to form at least one thread in the workpiece. The power tool can be operated to produce a continuous rotary motion which is employed to drive the SDST screw such that the SDST screw is tightened to the workpiece. It will be appreciated that a power tool constructed in accordance with the teachings of the present disclosure can change between continuous rotary motion and rotating impacting motion automatically (i.e., without input from the operator or user of the tool) and that the automatic change-over can be based on a predetermined torsional output of the power tool (i.e., automatic change-over can occur at a predetermined trip torque). We have found, for example, that a trip torque of between 0.5 Nm and 2 Nm, and more particularly a trip torque of between 1 Nm and 1.5 Nm is particularly well suited for use in driving commercially-available TEK fasteners into sheet metal workpieces of the type that are commonly employed in HVAC systems and commercial construction (e.g., steel studs). We have also discovered that it is desirable that the impacting mechanism provide a relatively small torsional spike of between about 0.2 J to about 5.0 J and more preferably between about 0.5 J to about 2.5 J when the power tool is configured to drive TEK fasteners into sheet steel workpiece. More specifically, the combination of the aforementioned trip-torque and torsional spike cause the tool to operate substantially as a tool with a continuous rotating output that switches over briefly into an impacting mode to complete the formation of a hole in the sheet steel workpiece and/or to form threads in the sheet steel workpiece.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A power tool comprising:

a housing;

a motor with an output shaft, the motor being received in the housing assembly;

a transmission driven by the output shaft, the transmission comprising an output stage with a plurality of planet gears, a planet carrier journally supporting the planet gears for rotation about an axis, and a ring gear in meshing engagement with the planet gears, the ring gear being rotatable relative to the housing about the axis;

a spindle coupled for rotation with the planet carrier; and an impact mechanism received in the housing assembly and comprising a plurality of anvil lugs, an impactor and an impactor spring, the impactor being mounted to pivot about the spindle and having a plurality of hammer lugs, the impactor spring biasing the impactor toward the ring gear to cause the hammer lugs to engage the anvil lugs.

2. The power tool of claim 1, further comprising an adjustment mechanism coupled to the housing assembly and configured to permit a user to adjust a load exerted by the impactor spring on the impactor.

3. The power tool of claim 2, wherein the adjustment mechanism comprises an adjustment collar that is mounted concentrically about the spindle.

4. The power tool of claim 1, wherein the impact mechanism includes a torsion spring that biases the impactor in a predetermined rotational direction relative to the housing assembly.

5. The power tool of claim 1, wherein the impact mechanism includes a cam mechanism that permits limited rotational and axial movement of the impactor relative to the housing assembly so that the anvil lugs can cam over the hammer lugs to urge the impactor away from the ring gear when a reaction torque applied to the ring gear exceeds a predetermined trip torque.

6. The power tool of claim 5, wherein the housing assembly comprises a housing and a gear case that is removably coupled to the housing, wherein the ring gear is received in the gear case and wherein a thrust member is engaged to the gear case to limit movement of the ring gear in an axial direction toward the motor.

7. The power tool of claim 5, wherein the anvil lugs extend radially or axially from the ring gear.

8. The power tool of claim 5, wherein the impactor spring is a compression spring that is received between the housing assembly and the impactor to bias the hammer lugs into engagement with the anvil lugs.

9. The power tool of claim 8, wherein a thrust bearing is received between the compression spring and the impactor, the housing assembly or both the impactor and the housing assembly.

10. The power tool of claim 8, wherein the impactor includes an annular wall member that is spaced radially apart from the spindle, the compression spring being received radially outwardly of the annular wall.

11. A power tool comprising:

a housing;

a motor with an output shaft, the motor being received in the housing assembly;

a transmission driven by the output shaft, the transmission comprising an output stage with a plurality of planet gears, a planet carrier journally supporting the planet gears for rotation about an axis, and a ring gear in meshing engagement with the planet gears, the ring gear being mounted for rotation about the axis;

a spindle coupled for rotation with the planet carrier; and an impact mechanism received in the housing assembly and comprising a plurality of anvil lugs, an impactor and an impactor spring, the impactor being mounted to pivot about the spindle and having a plurality of hammer lugs, the impactor spring biasing the impactor toward the ring gear to cause the hammer lugs to engage the anvil lugs;

wherein the impact mechanism includes a cam mechanism that permits limited rotational and axial movement of the impactor relative to the housing assembly so that the anvil lugs can cam over the hammer lugs to urge the impactor away from the ring gear when a reaction torque applied to the ring gear exceeds a predetermined trip torque.

12. The power tool of claim 11, wherein the housing assembly comprises a housing and a gear case that is removably coupled to the housing, wherein the ring gear is received in the gear case and wherein a thrust member is engaged to the gear case to limit movement of the ring gear in an axial direction toward the motor.

13. The power tool of claim 11, wherein the anvil lugs extend radially or axially from the ring gear.

14. The power tool of claim 11, wherein the impactor spring is a compression spring that is received between the housing assembly and the impactor to bias the hammer lugs into engagement with the anvil lugs.

15. The power tool of claim 14, wherein a thrust bearing is received between the compression spring and the impactor, the housing assembly or both the impactor and the housing assembly.

16. The power tool of claim 14, wherein the impactor includes an annular wall member that is spaced radially apart from the spindle, the compression spring being received radially outwardly of the annular wall.

17. A power tool comprising:

a motor;

a transmission driven by the motor, the transmission having an output member;

an output spindle coupled to the output member for rotation therewith;

a rotary impact mechanism cooperating with the transmission to drive the output spindle, the rotary impact mechanism including a plurality of anvil lugs that are mounted to a ring gear of the transmission for rotation therewith, an impactor, and an impactor spring, the impactor being movable axially and pivotally on the output spindle and including a plurality of hammer lugs, the impactor spring biasing the impactor in a predetermined axial direction to cause the hammer lugs to engage the anvil lugs, the rotary impact mechanism being operable in a direct drive mode, in which the hammer lugs and the anvil lugs remain engaged to one another, and a rotary impact mode, in which the impactor reciprocates and pivots to permit the hammer lugs to repetitively engage and disengage the anvil lugs and thereby generate a rotary impulse.

18. The power tool of claim 17, further comprising an adjustment mechanism for setting a trip torque at which the rotary impact mechanism will switch between the direct drive mode and the rotary impact mode.

19. The power tool of claim 18, wherein the adjustment mechanism comprises an adjustment collar that is mounted concentrically about the spindle.

20. The power tool of claim 17, wherein the impact mechanism includes a torsion spring that biases the impactor in a predetermined rotational direction relative to a housing.

21. The power tool of claim 17, wherein the transmission includes a planetary stage with a ring gear and wherein the anvil lugs are coupled to the ring gear.

22. The power tool of claim 17, wherein the rotary impact mechanism includes a cam mechanism that permits limited rotational and axial movement of the impactor relative to a housing.

23. A power tool comprising:

a motor;

a spindle;

a transmission driven by the motor; and a rotary impact mechanism cooperating with the transmission to drive the spindle, the rotary impact mechanism including a plurality of anvil lugs, an impactor, and an impactor spring, the impactor being movable axially and pivotally on the spindle and including a plurality of hammer lugs, the impactor spring biasing the impactor in a predetermined axial direction to cause the hammer lugs to engage the anvil lugs, the rotary impact mechanism being operable in a direct drive mode, in which the hammer lugs and the anvil lugs remain engaged to one another, and a rotary impact mode, in which the impactor reciprocates and pivots to permit the hammer lugs to repetitively engage and disengage the anvil lugs and thereby generate a rotary impulse;

wherein the anvil lugs are mounted to a member of the transmission;

wherein the transmission includes a planetary stage with a ring gear and wherein the anvil lugs are coupled to the ring gear.

24. The power tool of claim 23, further comprising an adjustment mechanism for setting a trip torque at which the rotary impact mechanism will switch between the direct drive mode and the rotary impact mode.

25. The power tool of claim 24, wherein the adjustment mechanism comprises an adjustment collar that is mounted concentrically about the spindle.

26. The power tool of claim 23, wherein the impact mechanism includes a torsion spring that biases the impactor in a predetermined rotational direction relative to a housing.

27. A power tool comprising:

a motor;

a spindle;

a transmission driven by the motor; and a rotary impact mechanism cooperating with the transmission to drive the spindle, the rotary impact mechanism including a plurality of anvil lugs, an impactor, and an impactor spring, the impactor being movable axially and pivotally on the spindle and including a plurality of hammer lugs, the impactor spring biasing the impactor in a predetermined axial direction to cause the hammer lugs to engage the anvil lugs, the rotary impact mechanism being operable in a direct drive mode, in which the hammer lugs and the anvil lugs remain engaged to one another, and a rotary impact mode, in which the impactor reciprocates and pivots to permit the hammer lugs to repetitively engage and disengage the anvil lugs and thereby generate a rotary impulse;

wherein the anvil lugs are mounted to a member of the transmission; and wherein the rotary impact mechanism includes a cam mechanism that permits limited rotational and axial movement of the impactor relative to a housing.

28. The power tool of claim 27, further comprising an adjustment mechanism for setting a trip torque at which the rotary impact mechanism will switch between the direct drive mode and the rotary impact mode.

29. The power tool of claim 28, wherein the adjustment mechanism comprises an adjustment collar that is mounted concentrically about the spindle.

30. The power tool of claim 27, wherein the impact mechanism includes a torsion spring that biases the impactor in a predetermined rotational direction relative to a housing.

* * * * *